US008596485B2

(12) United States Patent
Lindsay

(10) Patent No.: US 8,596,485 B2
(45) Date of Patent: Dec. 3, 2013

(54) LATCHABLE LID ASSEMBLIES

(75) Inventor: Brendan Jon Lindsay, Auckland (NZ)

(73) Assignee: Sistema Plastics Limited, Auckland (NZ)

( * ) Notice: Subject to any disclaimer, the term of this patent is extended or adjusted under 35 U.S.C. 154(b) by 1572 days.

(21) Appl. No.: 11/793,022

(22) PCT Filed: Aug. 16, 2005

(86) PCT No.: PCT/NZ2005/000209

§ 371 (c)(1), (2), (4) Date: Sep. 14, 2007

(87) PCT Pub. No.: WO2006/065151

PCT Pub. Date: Jun. 22, 2006

(65) Prior Publication Data

US 2008/0105684 A1 May 8, 2008

(30) Foreign Application Priority Data

Dec. 14, 2004 (NZ) ..... 537287

(51) Int. Cl.
*B65D 45/16* (2006.01)

(52) U.S. Cl.
USPC ..... 220/326

(58) Field of Classification Search
USPC ..... 220/324, 326, 831, 832; 292/116, 194, 292/195, 202, DIG. 37
See application file for complete search history.

(56) References Cited

U.S. PATENT DOCUMENTS

| | | | | |
|---|---|---|---|---|
| D244,353 | S | 5/1977 | Skjelby et al. | |
| D248,090 | S | 6/1978 | Box | |
| 4,244,612 | A | 1/1981 | Schurman | 292/249 |
| 4,522,312 | A | 6/1985 | Rathgeber et al. | 220/324 |
| 5,363,978 | A | 11/1994 | Molo | |
| 5,762,228 | A | 6/1998 | Morgan | |
| 6,035,769 | A | 3/2000 | Nomura | |
| D493,073 | S | 7/2004 | Kim | |
| 6,789,692 | B2 * | 9/2004 | Prezelin | 220/324 |
| 6,955,381 | B2 * | 10/2005 | Parker et al. | 292/113 |
| D521,811 | S | 5/2006 | Yourist | |
| D524,119 | S | 7/2006 | Kim | |
| 7,090,089 | B2 * | 8/2006 | Lown et al. | 220/324 |
| D582,730 | S | 12/2008 | Kim | |
| D601,857 | S | 10/2009 | Carlson | |
| D610,412 | S | 2/2010 | Matsumoto | |
| D644,888 | S | 9/2011 | Samartgis | |
| 2003/0010783 | A1 * | 1/2003 | Prezelin | 220/324 |
| 2004/0232026 | A1 | 11/2004 | Goeking | |
| 2005/0006390 | A1 | 1/2005 | Wang | |
| 2005/0035125 | A1 | 2/2005 | Bae | |

FOREIGN PATENT DOCUMENTS

| | | |
|---|---|---|
| NZ | 404956 | 7/2004 |
| NZ | 404959 | 7/2004 |

(Continued)

*Primary Examiner* — Steven A. Reynolds
*Assistant Examiner* — King M Chu
(74) *Attorney, Agent, or Firm* — Jacobson Holman PLLC

(57) ABSTRACT

A latchable lunchbox container having a molded lid, a plurality of molded latch forms each pivotally supported from the molded lid, and a container closable by the molded lid. Each latch is pivotally supported by a clip fit between the molded lid and the latch. The lid molding includes at least one formation for each latch whereby an abutment will occur that will reduce the likelihood of prizing of a latch from the lid molding as a result of the latch moving upwardly about its pivot axis. Each latch provides at least one cylindrical surface to be carried in at least one click fit feature therefor thereby to provide a journalled bearing defining the pivot axis.

7 Claims, 5 Drawing Sheets

(56) References Cited

FOREIGN PATENT DOCUMENTS

| | | |
|---|---|---|
| NZ | 404962 | 7/2004 |
| NZ | 410465 | 9/2008 |
| NZ | 410643 | 9/2008 |
| NZ | 564245 | 5/2011 |
| WO | 02/26087 | 4/2002 |
| WO | WO02/059007 | 8/2002 |

* cited by examiner

LATCHABLE LID ASSEMBLIES

This is a national stage of PCT/NZ2005/000209 filed 16 Aug. 2005 and published in English.

FIELD OF THE INVENTION

The present invention relates to lid and latch assemblies, container assemblies which includes such a lid and latch assembly, and related methods, procedures, components and sub assemblies.

BACKGROUND OF THE INVENTION

Many containers are provided whereby moulded components interrelate to provide a container and lidding arrangement such that the lid can be engaged in a substantially fluid and/or air tight manner or otherwise be held in a fixed relationship with the container.

One range of products finding wide spread popularity are the SISTEMA™ branded and KLIP-IT™ type assemblies manufactured by us. Generally such arrangements however have the latching mouldings pivoting from formations of the container and the engagement to hold down a closure or lid is by virtue of these latches being pivoted on journals up over top of the periphery of the lid. Such systems are effective and have considerable eye appeal.

With containers having a round section when viewed in plan, or where latching needs to occur on an otherwise curved wall region, there can be reliance on a latching moulding which is to move downwardly from the lid from which it is hinged or pivoted to engage a peripheral rim exterior, exterior rim of the moulded container. The present invention wishes to provide options to any such system.

SUMMARY OF THE INVENTION

In one aspect the present invention recognizes the desirability of being able to click or clip fit a pair of components together so that a latch member can be uplifted about a journal bearing axis to open a lid it complements and be pivoted downwardly to achieve a latched closure.

The present invention in one of its aspects envisages a restriction of the movement of the latch during its uplift movement so that it remains in its journalled bearing condition. The preferred form of the present invention envisages each latch moulding having a pair of spaced journals each of which is to be journalled in an outstanding bearing lug from the lid into which each click or clip fits from above and it is a formation between such outstanding lugs, itself an outstanding projection, which is to limit (in a manner shown in the drawings and substantially as hereinafter described) the uplifting of the latch or its leverage off the lugs.

In another aspect the present invention consists in a lid assembly for a container, the lid assembly being or having a moulded lid with a plurality of peripherally disposed moulded latches;

wherein each latch is click or clip engagement journalled by a moulded form or moulded forms ("form(s)") of the lid so as to be capable of being pivoted downwardly to, and upwardly from, a latching condition with a complementary container, and wherein at least one formation ("formation(s)") of the lid interacts with each latch on its pivoting to restrict or discourage further pivoted movement upwardly likely lever the latch free of its moulded form(s).

Preferably each latch is a moulded form having two regions thereof in a spaced relationship each adapted to be click or clip engagement journalled by a moulded form of the lid, the moulded form for each latch being spaced.

Preferably each moulded form is adapted to click or clip engage journal its region of the latch from a direction from above the lid.

Preferably there is one formation for each latch, said one formation being adapted to act between journalled regions of that latch.

Preferably the formation(s) is such that each of the latches at its upper pivoted condition is directed substantially outwardly and not upwardly of the perimeter of the lid.

Preferably each latch includes a shoulder or shoulders to underlie at least one retention form of a complementary container.

A lid substantially as herein described with reference to at least one latch arrangement.

In another aspect the present invention consists in assembly or in combination, a container, and a lid assembly for the container, wherein the lid assembly is of a moulded lid with a plurality of peripherally disposed moulded latches, each latch click or clip fit engaged to or by the lid pivoted from so as to be capable of being pivoted downwardly to, and upwardly from, a latching condition where each latch underlies in part a retention feature of the container, at least one formation ("formation(s)") of the lid interacting with each latch on its pivoting to restrict or to discourage pivoted movement upwardly likely to lever the latch free of its click or clip fit engagement.

In another aspect the present invention consists in assembly or combination a container and a lid assembly where the lid assembly includes one moulded latch engaged with a moulded lid in a manner substantially as herein described with reference to any one or more of the accompanying drawings and having an interaction to restrict click or clip journaling disengagement when each latch is uplifted.

In another aspect the present invention consists in a latchable container comprising or including a moulded lid, a plurality of moulded latch forms each pivotally supported from the moulded lid, and a container closable by the moulded lid, wherein each latch is pivotally supported by a click or clip fit between the moulded lid and the latch, and wherein the lid moulding includes at least one formation for each latch whereby an abutment will occur that will reduce the likelihood of prizing of a latch from the lid moulding as a result of the latch moving upwardly about its pivot axis.

In a further aspect the present invention consists in a latchable container wherein each latch provides at least one cylindrical surface to be carried in at least one click or clip fit feature therefor thereby to provide a journalled bearing defining the pivot axis.

In another aspect the present invention consists in a lid and latch assembly suitable for closure of a suitable container by a bearing journalled pivoting down of the latch to engage the suitable container, wherein the latch has had its at least one journal (preferably a spaced pair) click or clip engaged into a bearing structure(s) of the lid, and wherein at least one formation of the lid interacts with the latch on its uplifting to restrict movement and/or leverage likely to free the journal(s) from the bearing structure(s).

In yet a further aspect the present invention consists in a lid and latch assembly wherein the lid has any of the features hereinafter described by reference to the region identified as "A" and/or an assembly results whereby there is the appearance and/or the movement restrictions relative to the free movement of the journal relative to each lug substantially in a manner as hereinafter described with reference to any one or more of the accompanying drawings.

In yet a further aspect the present invention consists in an individual component of a lid and match assembly in accordance with the present invention.

In yet a further aspect the present invention consists in a container, a lid for container and multiple latches in combination or sub assembly or assembly, wherein the lid and latches each is as in an assembly as aforesaid.

BRIEF DESCRIPTION OF THE DRAWINGS

One preferred form of the present invention will now be described with reference with the accompanying drawings in which.

DETAILED DESCRIPTION OF THE PREFERRED EMBODIMENTS

Figure 1:
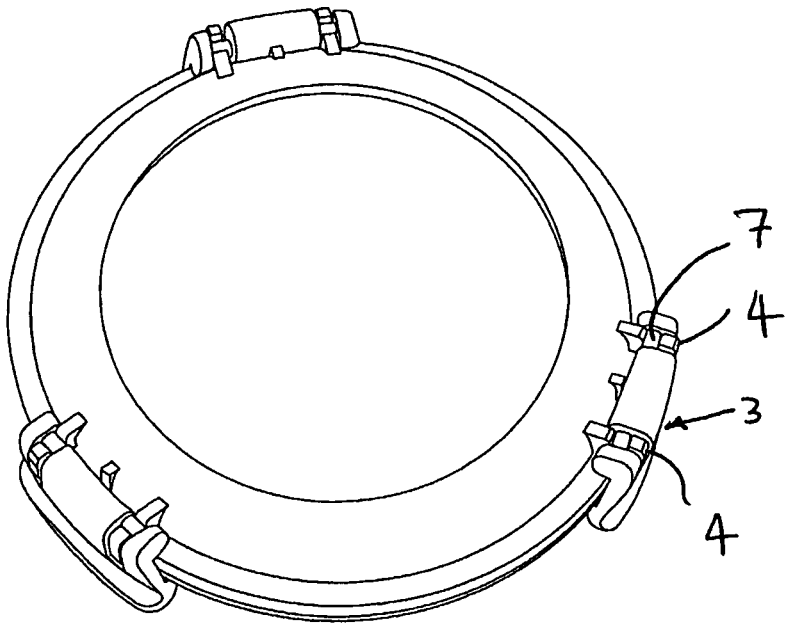
FIG. 1 is a preferred three latch lid assembly in accordance with the present invention.

In accordance with the present invention the plastic components are all moulded from an acceptable thermoplastics material. At least the lid 1 and the container 2 should be of a food grade plastics material. Preferably likewise the latch member 3 but not necessarily so.

Any suitable moulded materials can be used for the various components but preferably all are of a suitable plastics material. Most preferably the lids 1 and containers 2 are of polypropylene and the latches 3 are of high impact styrene.

Figure 7:
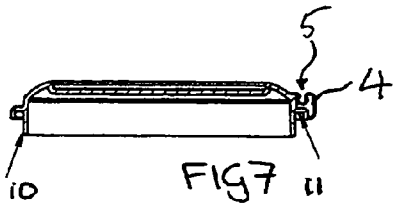
FIG. 7 is the section "CC" with respect to FIG. 6.
Figure 6:
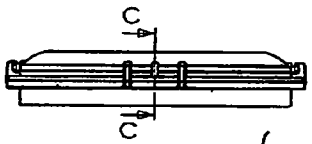
FIG. 6 is a side elevation of the arrangement shown in FIG. 5.
Figure 5:
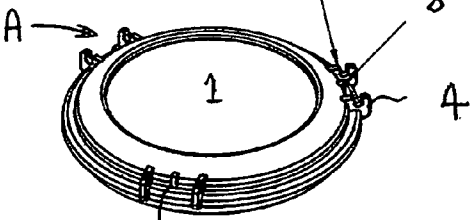
FIG. 5 is a perspective view from above showing the three sets of formations which provide the clip retainer lugs on each side of the clip stop which is to receive but restrict the movement of a latch as shown in FIGS. 3 and 4.
Figure 9:
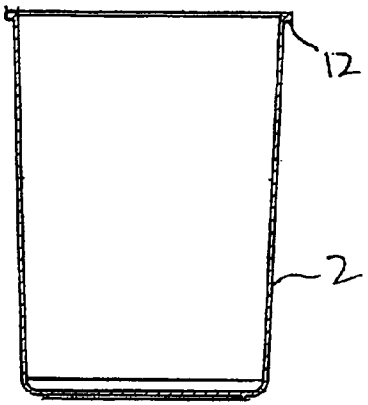
FIG. 9 is a section "AA" of the container of FIG. 8.
Figure 11:
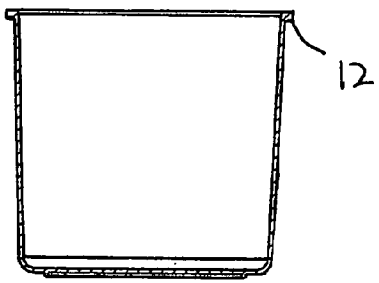
FIG. 11 is a section "BB" of the container of FIG. 10, and FIG. 12, in elevation, shows one latch of an assembly of FIGS. 1 and 2 on a container of FIGS. 8 to 11 holding the lid closed by virtue of the shoulder of the rim of the container being engaged by the shoulder of the latch.
Figure 8:
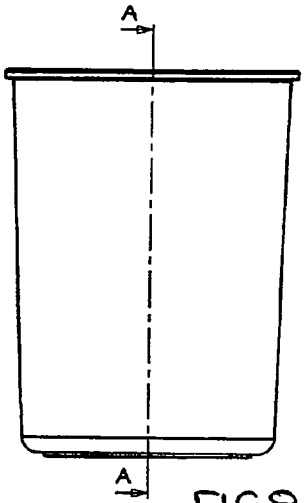
FIG. 8 is a side elevation of a round container in accordance with the present invention with an exterior rim.
Figure 10:
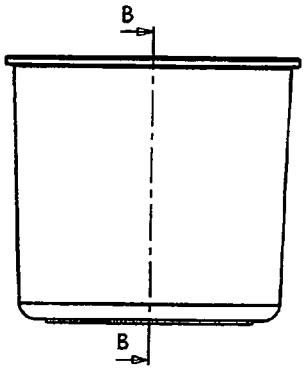
FIG. 10 is a more shallow round container to that of FIG. 8.

Shown in FIGS. 5 through 7 are outstanding journal bearing members 4 and 6 each having a bearing cavity with a mouth with a constricted entrance 5 to click or clip ("click") retain as lugs a journal bearing 7 (preferably of a full cylindrical surface) of a latch 3. Of course, in other variants the click forms could be of the latches, or shared by both the lid and the latch.

Interposed between the spaced lugs 6 is a latch stop 8 formation which has the affect of abutting against the offset region 9 of the latch moulding 3 which is offset outwardly and thus above the bearing or journal bearing axis I-I. It prevents movement of the latch to a point where it bears on the lid to lever its regions 7 through the constricted entrances 5.

Preferably, when considered from a direction parallel to the pivot axis, the latch 3 has a general "L" shape with the longer "limb" being the handle for latching/delatching and the shorter "limb" having the pivot axis near its distal extremity. The abutment with a formation such as 8 is by the proximal region of the shorter "limb". The preferred shoulder 13 (to be discussed later) is inwardly of the longer "limb" away from the longer "limbs" proximal region.

Whilst stop 8 is a discrete formation as shown, it could be (in less preferred forms) part of an expansive region spanning at least to some extent between members 4.

Whilst members 4 show a constricted opening from strictly above, other variations can be entertained. It is the role of the abutment of lid form 8 and the latch member region 9 to ensure no accidental prizing of the latch member 3 from the lid moulding 1 occurs.

Figure 2:
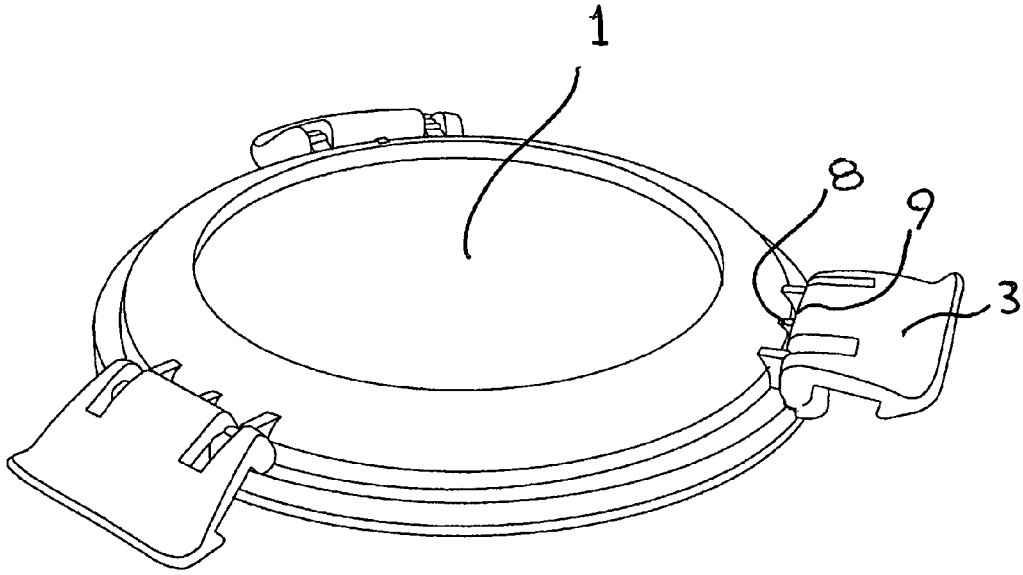
FIG. 2 is the same assembly as shown in FIG. 1 but with one of the latch members uplifted to the limit of its movement about its journal axis, the limit being provided by an interengagement of an offset of the moulded latch and an outstanding formation of the lid itself.
Figure 3:
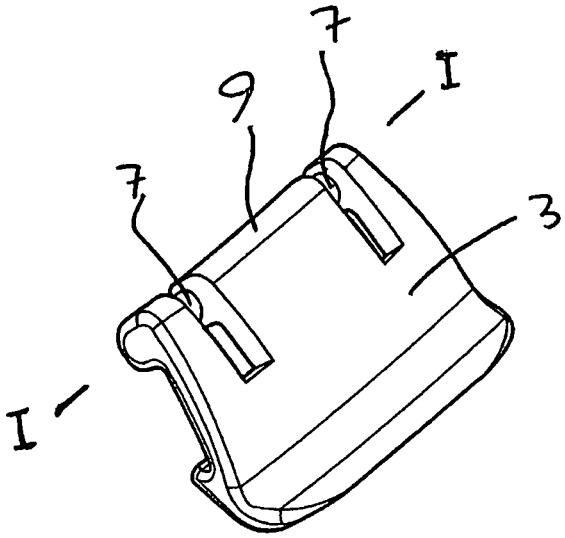
FIG. 3 shows a perspective view of the exterior of a latch in accordance with the present invention.
Figure 4:
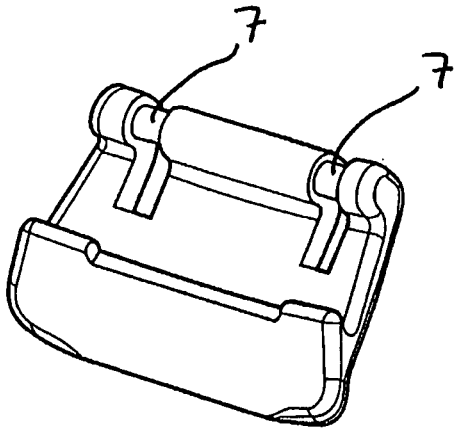
FIG. 4 shows the reverse view of the moulding of FIG. 3.

Persons skilled in the art will appreciate how, with the upwardly facing openings 5 of the bearing lugs 4 and 6, the engagement that occurs as in the condition shown in FIG. 2 will have the affect of preventing accidental removal of the latch member 3 from the lid moulding 1 during opening of a member 3 from the lid 1.

Persons skilled in the art will see from the drawings how preferably the lid associates as a cone seal 10 and with a peripheral seal groove 11 with a complementary container as shown.

Figure 12:
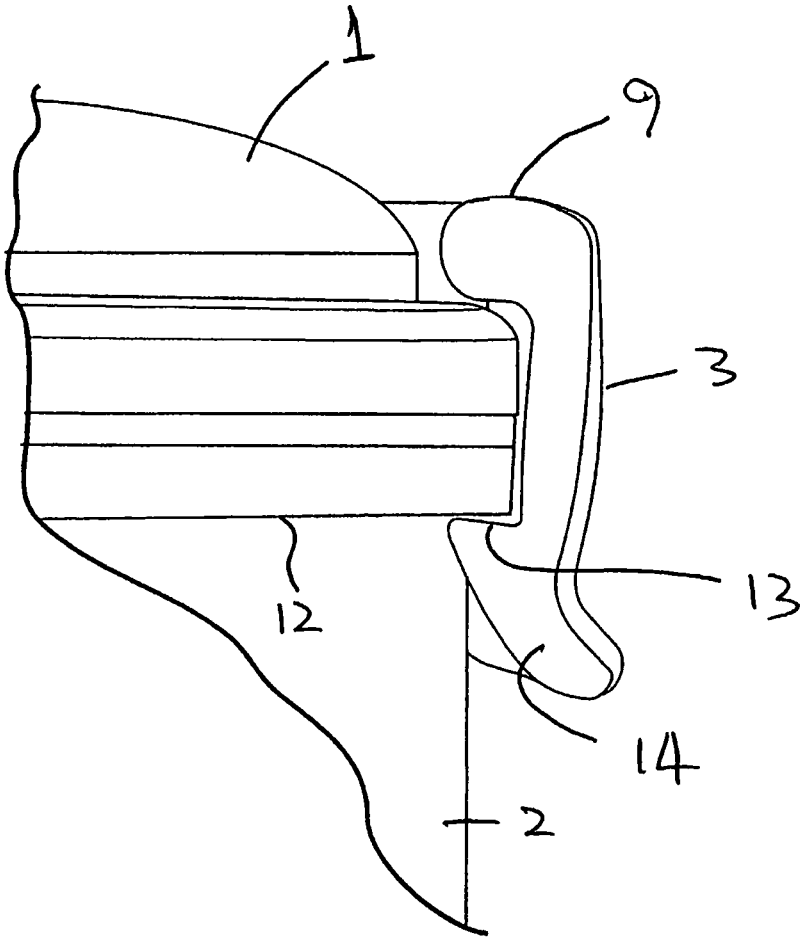

FIG. 12 shows the retention feature of the container, a shoulder 12 being engaged by the continuous or discontinuous feature (e.g. an opposite shoulder or the equivalent) 13 of the latch 3. Preferably the features 12 and 13 interengage (e.g. click fit or reliant on material resilience) so as to not readily disengage. The latch 3 has a manually accessible region 14 to allow the latch to be prized upwards.

The present invention therefore whilst being described by reference to a round container has an assembly whereby even roundness of interrelated parts of a container or other similar curvature need not necessarily have an untoward affect during uplifting to open a latched lid of a kind typified by the present invention.

I claim:

1. A lid assembly for a container, the lid assembly comprising a moulded lid with a plurality of peripherally disposed moulded latches;

each latch being clip engagement journalled into at least one moulded assembly, each said at least one moulded assembly having upwardly facing openings of journal bearing members with each latch being clip engagement journalled in said journal bearing members having said upwardly facing openings so that each latch is capable of being pivoted downwardly to, and upwardly from, a latching condition with a complementary container, and at least one formation of the lid interacting with each latch on pivoting of each latch to restrict or discourage further pivoted movement upwardly to prevent movement of the latch to a point where the latch bears on the lid such that the latch would be likely to lever free of the least one moulded assembly through said upwardly facing openings.

2. The lid as claimed in claim 1, wherein each latch has two regions thereof in a spaced relationship with each of the two regions adapted to be clip engagement journalled by the at least one moulded assembly of the lid.

3. The lid as claimed in claim 2, wherein each moulded assembly is adapted to clip engage journal the two regions of the latch from a direction from above the lid.

4. The lid as claimed in claim 1, wherein there is one formation for each latch, said one formation being adapted to act between journalled regions of each latch.

5. The lid as claimed in claim 4, wherein the one formation is positioned such that each of the latches in an upper pivoted condition is directed substantially outwardly and not upwardly with respect to a perimeter of the lid.

6. The lid as claimed in claim 1, wherein each latch includes at least one shoulder to underlie at least one retention form of a complementary container.

7. An assembly having, in combination, a container, and a lid assembly for the container, the lid assembly including a moulded lid with a plurality of peripherally disposed moulded latches;

each latch being clip engagement journalled into at least one moulded assembly, each said at least one moulded assembly having upwardly facing openings of journal bearing members with each latch being clip engagement journalled in said journal bearing members having said upwardly facing openings so that each latch is capable of being pivoted downwardly to, and upwardly from, a latching condition with a complementary container, and at least one formation of the lid interacting with each latch on pivoting of each latch to restrict or discourage further pivoted movement upwardly to prevent movement of the latch to a point where the latch bears on the lid such that the latch would be likely to lever free of the least one moulded assembly through said upwardly facing openings and in a latching condition each latch underlying in part a retention feature of the container.

* * * * *

UNITED STATES PATENT AND TRADEMARK OFFICE

CERTIFICATE OF CORRECTION

PATENT NO. : 8,596,485 B2
APPLICATION NO. : 11/793022
DATED : December 3, 2013
INVENTOR(S) : Brendan Jon Lindsay It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1151 days.

Signed and Sealed this
Twenty-second Day of September, 2015

Michelle K. Lee

Michelle K. Lee
*Director of the United States Patent and Trademark Office*